US011701535B2

(12) United States Patent
Holmes

(10) Patent No.: US 11,701,535 B2
(45) Date of Patent: Jul. 18, 2023

(54) STRETCHING APPARATUS

(71) Applicant: Arturo E. Holmes, Smyrna, GA (US)

(72) Inventor: Arturo E. Holmes, Smyrna, GA (US)

( * ) Notice: Subject to any disclaimer, the term of this patent is extended or adjusted under 35 U.S.C. 154(b) by 33 days.

(21) Appl. No.: 17/082,241

(22) Filed: Oct. 28, 2020

(65) Prior Publication Data

US 2022/0126151 A1 Apr. 28, 2022

(51) Int. Cl.
*A63B 21/00* (2006.01)
*A63B 23/02* (2006.01)
(Continued)

(52) U.S. Cl.
CPC .. *A63B 21/00185* (2013.01); *A63B 21/00043* (2013.01); *A63B 21/065* (2013.01);
(Continued)

(58) Field of Classification Search
CPC ..... A63B 21/04; A63B 21/07; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/00; A63B 21/0004; A63B 21/00043; A63B 21/02; A63B 21/05; A63B 21/018; A63B 21/012; A63B 21/0125; A63B 21/015; A63B 21/026; A63B 21/028; A63B 21/06; A63B 21/08; A63B 21/15; A63B 21/151; A63B 21/00189; A63B 21/00185; A63B 21/072; A63B 21/0722; A63B 21/0724; A63B 21/0726; A63B 21/0728; A63B 21/075; A63B 21/078; A63B 21/0783; A63B 21/4033; A63B 21/4034; A63B 21/4035; A63B 21/4039; A63B 1/00; A63B 1/005; A63B 1/04; A63B 3/00; A63B 55/408; A63B 55/20; A63B 55/50; A63B 57/12; A63B 57/10; A63B 2071/0658; A63B 2071/0619; A63B 2071/0661; A63B 2071/0663; A63B 2071/0666; A63B 5/00; A63B 5/02;
(Continued)

(56) References Cited

U.S. PATENT DOCUMENTS 450,188 A 4/1891 Peterson
559,270 A 4/1896 Edwards
(Continued)

OTHER PUBLICATIONS

STIC search (Year: 2022).*
(Continued)

*Primary Examiner* — Megan Anderson
*Assistant Examiner* — Thao N Do
(74) *Attorney, Agent, or Firm* — Taylor English Duma LLP

(57) ABSTRACT

Example aspects of a stretching apparatus and a method for stretching a user's body are disclosed. The stretching apparatus can comprise an elongate support bar defining a bar first end and a bar second end opposite the bar first end; and a body stretching attachment coupled to the elongate support bar, the body stretching attachment comprising a primary strap, a first strap connector, and a second strap connector, wherein the primary strap comprises a flexible, inelastic material, and wherein the elongate support bar engages each of the first strap connector and second strap connector.

15 Claims, 7 Drawing Sheets

(51) Int. Cl.
*A63B 23/025* (2006.01)
*A63B 21/065* (2006.01)
*A63B 23/00* (2006.01)

(52) U.S. Cl.
CPC ..... *A63B 23/025* (2013.01); *A63B 23/0233* (2013.01); *A63B 23/0244* (2013.01); *A63B 2023/006* (2013.01); *A63B 2208/0204* (2013.01); *A63B 2208/029* (2013.01); *A63B 2225/09* (2013.01)

(58) Field of Classification Search
CPC .... A63B 5/04; A63B 5/06; A63B 5/16; A63B 5/20; A63B 5/205; A63B 5/22; A63B 2005/163; A63B 7/00; A63B 7/02; A63B 7/04; A63B 7/045; A63B 7/08; A63B 7/085; A63B 9/00; A63B 2009/004; A63B 17/00; A63B 17/02; A63B 17/04; A63B 69/0057; A63B 69/0059; A63B 69/0062; A63B 69/0064; A63B 69/0086; A63B 69/0088; A63B 26/00; A63B 26/003; A63B 2026/006; A63B 29/02; A63B 29/00; A63B 29/028; A63B 27/00; A63B 27/02; A63B 27/04; A63B 23/00; A63B 23/08; A63B 23/085; A63B 23/10; A63B 23/12; A63B 23/1218; A63B 23/1227; A63B 23/1236; A63B 23/02; A63B 23/0205; A63B 23/0211; A63B 23/0216; A63B 23/0222; A63B 23/0227; A63B 23/0233; A63B 23/0238; A63B 23/025; A63B 23/0244; A63B 23/03; A63B 23/035; A63B 23/03508; A63B 23/03516; A63B 23/03525; A63B 23/03533; A63B 23/03541; A63B 23/0355; A63B 23/03558; A63B 23/03566; A63B 23/03575; A63B 23/03583; A63B 23/03591; A63B 23/04; A63B 2023/006; A63B 2023/003
See application file for complete search history.

(56) References Cited

U.S. PATENT DOCUMENTS 1,234,793 A 7/1917 Olds
1,530,748 A 3/1925 Alastalo
1,543,346 A 6/1925 Titus
1,701,747 A 2/1929 Dobbins
1,734,238 A 11/1929 Sweeney
1,749,488 A * 3/1930 King ..... A63B 21/1636 601/39
1,837,153 A 12/1931 Ettinger
2,621,043 A * 12/1952 Olmstead ..... A63B 21/012 482/114
3,184,884 A 5/1965 Petrucelli
3,207,512 A 9/1965 Kinsey
3,613,294 A 10/1971 Graham
4,322,084 A * 3/1982 Reece ..... A63B 69/3667 473/273
4,735,412 A * 4/1988 Prsala ..... A63B 21/154 482/125
4,909,232 A 3/1990 Carella
5,022,648 A * 6/1991 Travis ..... A63B 21/045 482/148
5,100,129 A * 3/1992 Porter ..... A63B 23/08 482/79
5,125,649 A * 6/1992 Fuller ..... A63B 23/1209 482/106
5,135,453 A * 8/1992 Sollenberger ..... A63B 21/155 482/101
5,209,712 A * 5/1993 Ferri ..... A61H 1/02 482/131
5,403,253 A * 4/1995 Gaylord ..... A63B 69/0064 482/142
5,498,218 A 3/1996 Proctor et al.
5,505,677 A 4/1996 Hinds
5,711,044 A * 1/1998 Newman ..... A61G 7/1023 5/89.1
5,860,897 A * 1/1999 Gilbert ..... A63B 21/1609 482/130
5,885,196 A * 3/1999 Gvoich ..... A63B 21/00185 482/125
6,048,291 A * 4/2000 Fisher ..... A63B 21/0056 482/125
6,120,424 A * 9/2000 Arline ..... A63B 21/169 482/121
6,648,804 B2 * 11/2003 Chen ..... A63B 21/0004 482/125
8,613,690 B1 12/2013 Thompson
8,696,527 B2 4/2014 Wu
8,961,186 B2 * 2/2015 LoSasso ..... A63B 22/20 434/255
8,979,716 B1 * 3/2015 Rawlins ..... A63B 21/4043 482/129
9,259,605 B1 * 2/2016 Puig ..... A63B 23/1236
9,656,115 B2 5/2017 Young
9,775,764 B1 * 10/2017 Rill ..... A61H 1/0266
9,789,350 B1 10/2017 Wu
D872,200 S * 1/2020 Antezana ..... D21/692
10,682,543 B1 * 6/2020 Alvarez ..... A63B 21/4045
11,033,774 B1 * 6/2021 Clarke ..... A63B 21/00185
11,229,814 B1 * 1/2022 Weck ..... A63B 23/03508
2002/0072455 A1 * 6/2002 Akins ..... A63B 21/0783 482/109
2004/0058780 A1 3/2004 Edgeton
2004/0082447 A1 * 4/2004 Chaplin ..... A63B 21/0552 482/126
2004/0127339 A1 * 7/2004 Finn ..... A63B 21/00181 482/124
2004/0152569 A1 8/2004 Lerner
2004/0185990 A1 * 9/2004 Orescan ..... A63B 69/36 482/121
2005/0054497 A1 * 3/2005 Hull ..... A63B 21/4013 482/110
2005/0239617 A1 * 10/2005 Tenaglia ..... A63B 21/0552 482/904
2005/0266938 A1 * 12/2005 Sealy ..... A63B 69/0059 473/464
2005/0282689 A1 * 12/2005 Weinstein ..... A63B 21/0552 482/121
2006/0019806 A1 * 1/2006 Mikulski ..... A63B 23/03541 482/121
2006/0052222 A1 * 3/2006 Cardenas ..... A63B 7/02 482/148
2006/0169534 A1 * 8/2006 Green ..... A63B 27/00 182/7
2007/0287614 A1 * 12/2007 Fuller ..... A63B 21/0552 482/121
2008/0096737 A1 * 4/2008 Ayoub ..... A63B 21/0724 482/121
2008/0108486 A1 * 5/2008 Vigilia ..... A63B 21/4025 482/124
2008/0280738 A1 * 11/2008 Brennan ..... A63B 21/4035 482/129
2009/0111661 A1 * 4/2009 Hauser ..... A63B 23/1209 482/40
2009/0192022 A1 * 7/2009 Kulka ..... A63B 21/153 482/46
2010/0016132 A1 * 1/2010 Flynn ..... A63B 23/12 482/122
2010/0204014 A1 * 8/2010 Hoffman ..... A63B 69/0035 482/8
2010/0261583 A1 * 10/2010 Ferguson ..... A63B 21/4025 482/79
2010/0292056 A1 * 11/2010 Birch ..... A63B 21/1663 482/129

(56) References Cited

U.S. PATENT DOCUMENTS

2011/0045954 A1* 2/2011 Gutierrez ..... A63B 21/00 482/51
2011/0207586 A1* 8/2011 Whyatt ..... A63B 21/4017 482/139
2011/0230314 A1* 9/2011 Hoffman ..... A63B 23/047 482/51
2011/0237410 A1* 9/2011 Perez ..... A63B 21/16 482/129
2011/0251033 A1* 10/2011 Blancher ..... A63B 22/16 482/123
2012/0040808 A1 2/2012 Khademi
2012/0040809 A1* 2/2012 Formicola ..... A61H 1/0266 482/131
2012/0129658 A1* 5/2012 Hunt ..... A63B 23/1218 482/38
2012/0202662 A1* 8/2012 DeMarco ..... A63B 23/1236 482/143
2012/0214651 A1* 8/2012 Ross ..... A63B 21/0552 482/92
2012/0245000 A1* 9/2012 Burke ..... A63B 21/075 482/106
2012/0245002 A1 9/2012 Todd
2012/0302409 A1* 11/2012 Mikulski ..... A63B 21/0603 482/93
2012/0329620 A1* 12/2012 White ..... A63B 23/1236 482/131
2013/0012368 A1* 1/2013 Verruto ..... A63B 21/0004 482/124
2013/0053225 A1 2/2013 Meyer
2013/0116096 A1* 5/2013 Mikulski ..... A63B 21/0724 482/106
2013/0143724 A1* 6/2013 DeMeo ..... A63B 23/0205 482/131
2013/0196795 A1* 8/2013 Shocklee ..... A63B 60/24 473/457
2013/0217544 A1* 8/2013 Anaya ..... A63B 23/1218 482/40
2013/0217547 A1* 8/2013 Hinds ..... A63B 21/4035 482/96
2013/0333097 A1* 12/2013 Cranke ..... A63B 21/0557 2/300
2014/0080687 A1* 3/2014 Stuef ..... A63B 23/1272 482/129
2014/0200119 A1* 7/2014 Sides, Jr. ..... A63B 23/047 482/106
2014/0221176 A1 8/2014 Zylstra
2014/0274569 A1* 9/2014 Lewen ..... A63B 21/0421 482/121
2014/0274594 A1* 9/2014 Medina ..... A63B 21/065 482/105
2014/0274613 A1* 9/2014 DeMarco ..... A63B 21/4035 29/428
2014/0315695 A1 10/2014 Scott
2014/0336004 A1 11/2014 Gittleson et al.
2014/0342884 A1* 11/2014 Aldridge ..... A61H 1/0274 482/131
2015/0157893 A1 6/2015 Canevari
2015/0251038 A1* 9/2015 Bybee ..... A63B 21/4025 482/124
2015/0343253 A1* 12/2015 Nikkaran ..... A63B 21/154 482/96
2016/0023051 A1* 1/2016 Lauener ..... A63B 21/1636 482/143
2016/0082306 A1* 3/2016 Williams ..... A63B 21/00061 482/139
2016/0158594 A1* 6/2016 Penney ..... A63B 21/4035 264/331.13
2016/0228739 A1* 8/2016 Wu ..... A63B 21/4035
2016/0287935 A1 10/2016 Sykes
2017/0021263 A1* 1/2017 Kim ..... A63B 69/385
2017/0150786 A1* 6/2017 Ness ..... A63B 21/0552
2017/0203148 A1 7/2017 Askins
2017/0232289 A1* 8/2017 Pouchet ..... A63B 23/03533 482/93
2017/0239514 A1 8/2017 Hunt et al.
2017/0252621 A1* 9/2017 Ross ..... A63B 69/0059
2018/0001173 A1* 1/2018 Cupa ..... A63B 24/0062
2018/0290007 A1* 10/2018 Vorozilchak ..... A63B 21/1681
2018/0333601 A1* 11/2018 Coffman ..... A63B 21/0005
2019/0075878 A1 3/2019 Abraham
2019/0247704 A1* 8/2019 Mikulski ..... A63B 21/4035
2019/0282849 A1* 9/2019 Val Balent ..... A63B 71/0054
2019/0299042 A1* 10/2019 Slayton ..... A63B 21/00069
2020/0023229 A1* 1/2020 Oltorik ..... A63B 21/0557
2020/0054917 A1* 2/2020 Lin ..... A63B 21/0407
2020/0086158 A1* 3/2020 Mosebar ..... A63B 21/0555
2020/0171336 A1* 6/2020 Brown, Jr. ..... A63B 23/03508
2020/0230462 A1* 7/2020 McKeever ..... A63B 21/4009
2020/0269080 A1* 8/2020 Jaquish ..... A63B 21/00065
2022/0126152 A1* 4/2022 Holmes ..... A63B 21/00043

OTHER PUBLICATIONS

Updated STIC search (Year: 2022).*
Google search (Year: 2023).*
Zen Yoga Strap (https://web.archive.org/web/20200812031216/https://zenyogastrap.com/products/yoga-mat-strap) (Year: 2023).*
Way Back Machine (Year: 2023).*
Holmes, Arturo E.; Non-Final Office Action for U.S. Appl. No. 17/197,718, filed Mar. 10, 2021, dated Sep. 22, 2022, 57 pgs.

* cited by examiner

STRETCHING APPARATUS

TECHNICAL FIELD

This disclosure relates to athletic equipment. More specifically, this disclosure relates to stretching apparatus for stretching various parts of a user's body.

BACKGROUND

Stretching devices assist athletes and other users in stretching various parts of the user's body, including various muscles, tendons, ligaments, and the like. Many stretching devices comprise elastic straps or rubber bands that are configured to stretch during use of the stretching device. However, the elasticity of the straps can minimize the effectiveness of the stretching device by working the user's muscles (or other body parts) instead of stretching the muscles. Thus, many stretching devices do not allow for effective stretching and are better suited as workout devices. Furthermore, many stretching device have a single configuration, and are therefore limited in the types of stretches they provide to the user.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a stretching apparatus comprising an elongate support bar defining a bar first end and a bar second end opposite the bar first end; and a body stretching attachment coupled to the elongate support bar, the body stretching attachment comprising a primary strap, a first strap connector, and a second strap connector, wherein the primary strap comprises a flexible, inelastic material, and wherein the elongate support bar engages each of the first strap connector and second strap connector.

Also disclosed is a stretching apparatus comprising an elongate support bar defining a bar first end, a bar second end opposite the bar first end, and a bar midpoint between the bar first end and the bar second end; and a neck stretching attachment coupled to the elongate support bar, the neck stretching attachment comprising a head strap, a chin strap, and a bar attachment, wherein each of the head strap and chin strap comprises a flexible, inelastic material, and wherein the elongate support bar engages the bar attachment at the bar midpoint.

A method of stretching a user's body is also disclosed, the method comprising providing a stretching apparatus, the stretching apparatus comprising a support bar and a stretching attachment coupled to the support bar, the stretching attachment comprising a strap, the strap comprising a flexible, inelastic material; engaging the stretching attachment with a user's body; and biasing the support bar away from the user's body.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

FIG. 7 is a cross-sectional view of the support bar of FIG. 1 taken along line 7-7 in

FIG. 6.

DETAILED DESCRIPTION

Figure 1:
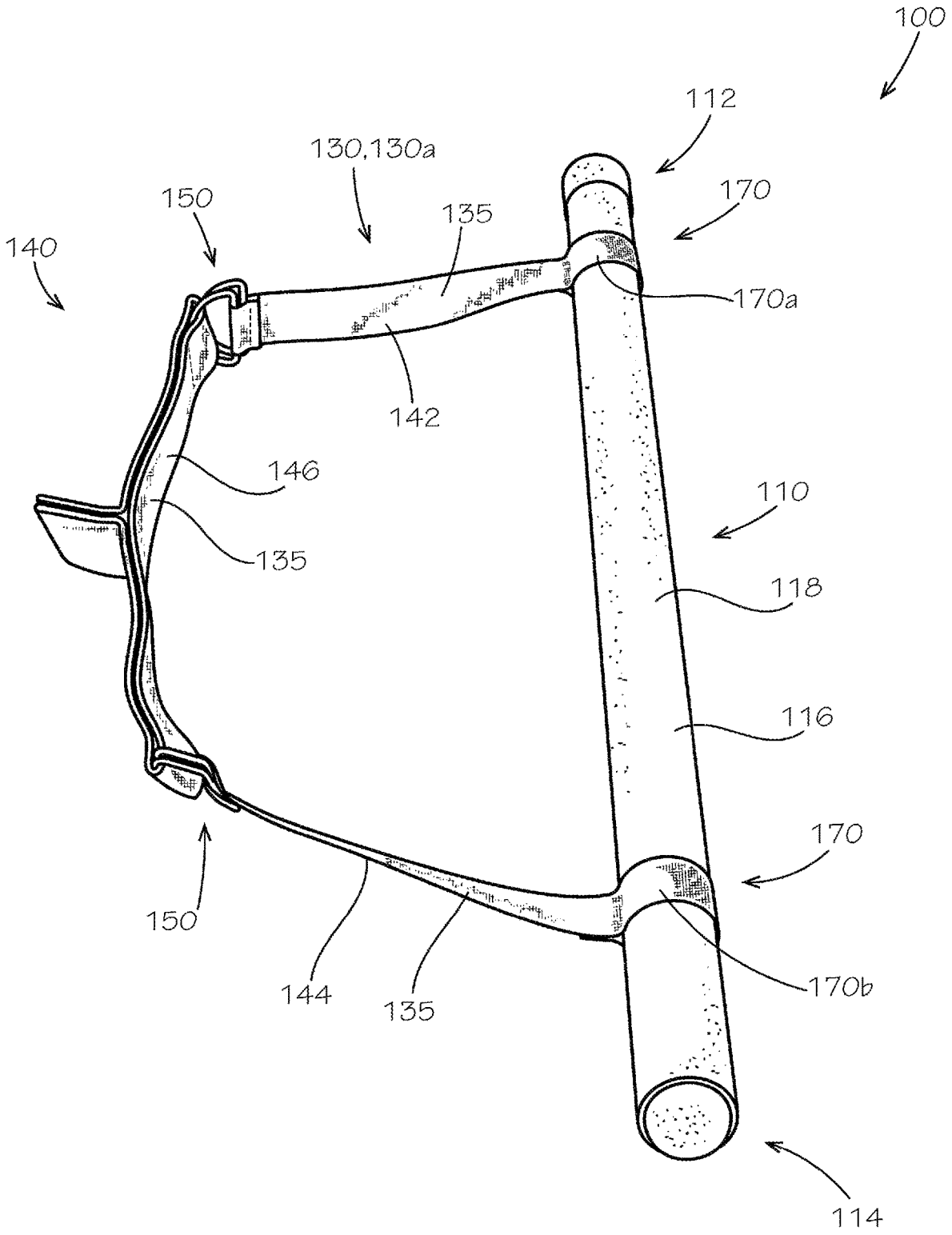
FIG. 1 is a perspective view of a stretching apparatus comprising a support bar and a first stretching attachment, in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a stretching apparatus and associated methods, systems, devices, and various apparatus. Example aspects of the stretching apparatus can comprise a support bar and a stretching attachment coupled to the support bar. In example aspects, the stretching attachment can comprise a flexible, inelastic strap. It would be understood by one of skill in the art that the stretching apparatus is described in but a few exemplary embodiments among many. No particular terminology or description should be considered limiting on the disclosure or the scope of any claims issuing therefrom.

FIG. 1 is a perspective view of a stretching apparatus 100, in accordance with one aspect of the present disclosure. The stretching apparatus 100 can be employed by a user to aid in stretching various area of the user's body—for example and without limitation, muscles and/or tendons in the user's neck, back, arms, chest, sides, and legs. As shown, example aspects of the stretching apparatus 100 can comprise an elongate support bar 110 and a stretching attachment 130 coupled to the support bar 110. In example aspects, the support bar 110 can define a substantially cylindrical shape having a circular cross-section, though in other aspects, the support bar 110 can comprise any other suitable shape known in the art. The support bar 110 can define a bar first end 112, a bar second end 114 opposite the bar first end 112, and an elongate bar middle region 116 extending therebetween. A bar midpoint 118 of the support bar 110 can be oriented approximately equidistant between the bar first end 112 and the bar second end 114. Example aspects of the support bar 110 are described in further detail below with respect to FIGS. 6-8.

Example aspects of the stretching attachment 130 can comprise one or more straps 135 comprising a flexible, but inelastic material, such as, for example, nylon. In the present aspect, the strap(s) 135 can comprise a nylon webbing. The flexibility of the straps 135 can allow the straps 135 to bend and fold as needed, and the inelasticity of the straps 135 can prohibit or limit the straps 135 from stretching under force (e.g., during use of the stretching apparatus 100). Limiting the elasticity of the straps 135 can allow for more effective stretching of the user's body when using the stretching apparatus 100. According to example aspects, the material of the straps 135, such as the nylon webbing, can also define a suitable strength allowing the straps 135 to withstand large forces without tearing or breaking during use of the stretching apparatus 100. In other aspects, the straps 135 can comprise any other suitable material known in the art, such as, for example, polypropylene webbing or another material. Furthermore, in still other aspects, the material of the straps 135 may define minimal or moderate elasticity to permit a limited about of stretching of the straps 135.

In the present aspect, the stretching attachment 130 can be a first stretching attachment **130*a*, which can be interchangeable with, or used in tandem with, additional stretching attachments 130, as described in further detail below. For example, in the present aspect, the first stretching attachment 130*a* can be a body stretching harness 140, which can be selectively detachable from the support bar 110. In other aspects, the stretching apparatus 100 may comprise a single one of the stretching attachments 130 and/or one or more of the stretching attachments 130 may be permanently coupled to the support bar 110. The body stretching harness 140 can comprise a single one of the straps 135 in some aspects, and can comprise a plurality of the straps 135 connected together in other aspects, as shown. For example, the body stretching harness 140 of the preset aspect can comprise a primary strap, such as a middle strap 146, and at least one secondary strap, such as a first end strap 142 and a second end strap 144. The middle strap 146 can generally extend between the first and second end straps 142,144. The middle strap 146 can be connected to each of the first end strap 142 and a second end strap 144 by a strap connector 150, and in some aspects, a length of the body stretching harness 140 can be adjustable at the strap connectors 150, as described in further detail below. Example aspects of the strap connectors 150 are described in further detail below with respect to FIGS. 2 and 3. In other aspects, the middle strap 146 can be coupled to the first and second end straps 142,144 by any other suitable fastener mechanism known in the art. Furthermore, in other aspects, the body stretching harness 140 may comprise the middle strap 146 and either the first or second end strap 142,144** only.

As shown, each of the first end strap 142 and second end strap 144 can be connected to the support bar 110 by a bar connector 170. In the present aspect, the first end strap 142 can define a first one of the bar connectors 170*a*, which can be coupled to the support bar 110 between the bar first end 112 and the bar midpoint 118 thereof, and the second end strap 144 can define a second one of the bar connectors 170*b*, which can be coupled to the support bar 110 between the bar second end 114 and the bar midpoint 118 thereof. In some aspects, the orientation of the bar connectors 170 can be adjustable along a length of the support bar 110, as described in further detail below with respect to FIG. 4. In other aspects, the first and second end straps 142,144 can be coupled to the support bar 110 by any suitable fastener mechanisms known in the art. Moreover, in other aspects, the body stretching harness 140 can comprise more or fewer straps 135, each of which may or may not be coupled to the support bar 110. As shown, according to example aspects, the body stretching harness 140 can substantially define a U-shape when coupled to the support bar 110 by the bar connectors 170 and suspended therefrom; however, the flexibility of the straps 135 can allow the body stretching harness 140 to bend into a variety of configurations. As described above, the straps 135 can also be substantially inelastic to prohibit or limit stretching of the straps 135 during use of the stretching apparatus 100.

The body stretching harness 140 can used in a variety of ways for stretching various parts of a user's body. According to a particular example aspect, the body stretching harness 140 can be configured to wrap around a user's back and under the user's arms. The support bar 110 can be oriented in front of the user, and the user can bias the support bar 110 away from their body. For example, the user can grip and push the support bar 110 generally forward and/or generally upward with their hands. This stretch can be configured to stretch various back, shoulder, and arm muscles. In other aspects, the body stretching harness 140 can be used in any other suitable fashion for stretching various parts of the user's body.

Figure 2:
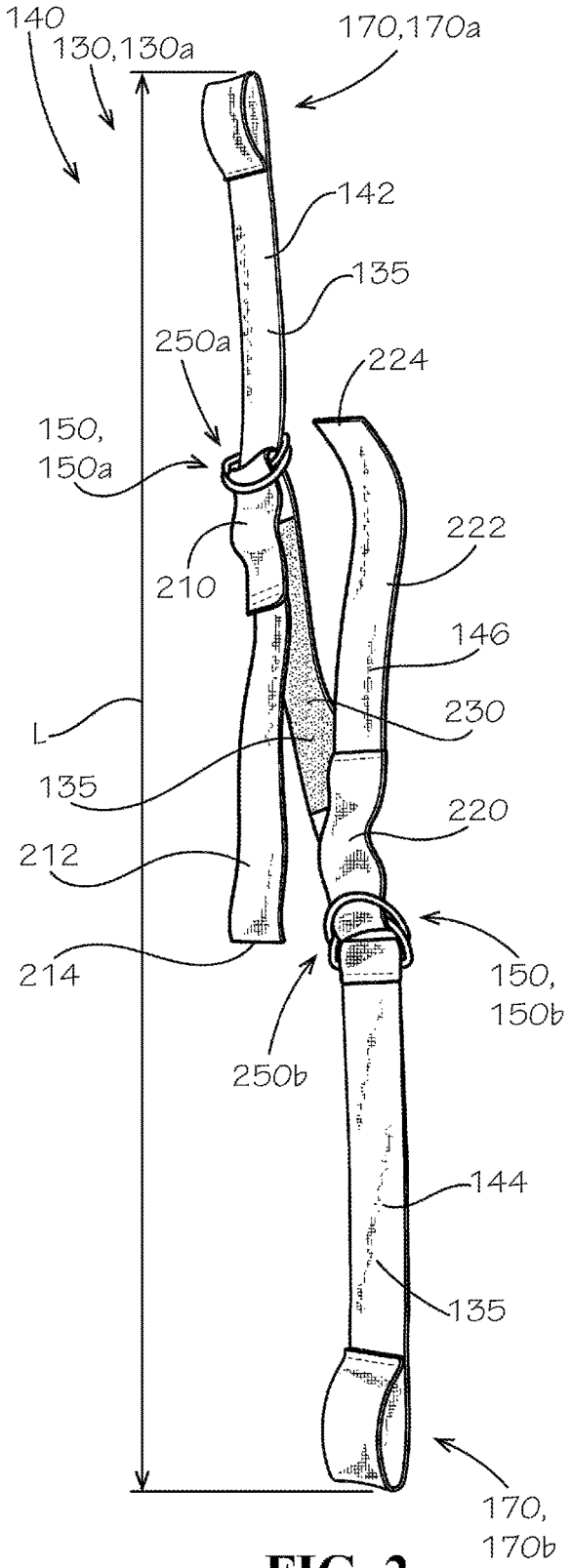
FIG. 2 is a front view of the first stretching attachment of FIG. 1 in an assembled configuration.
Figure 3:
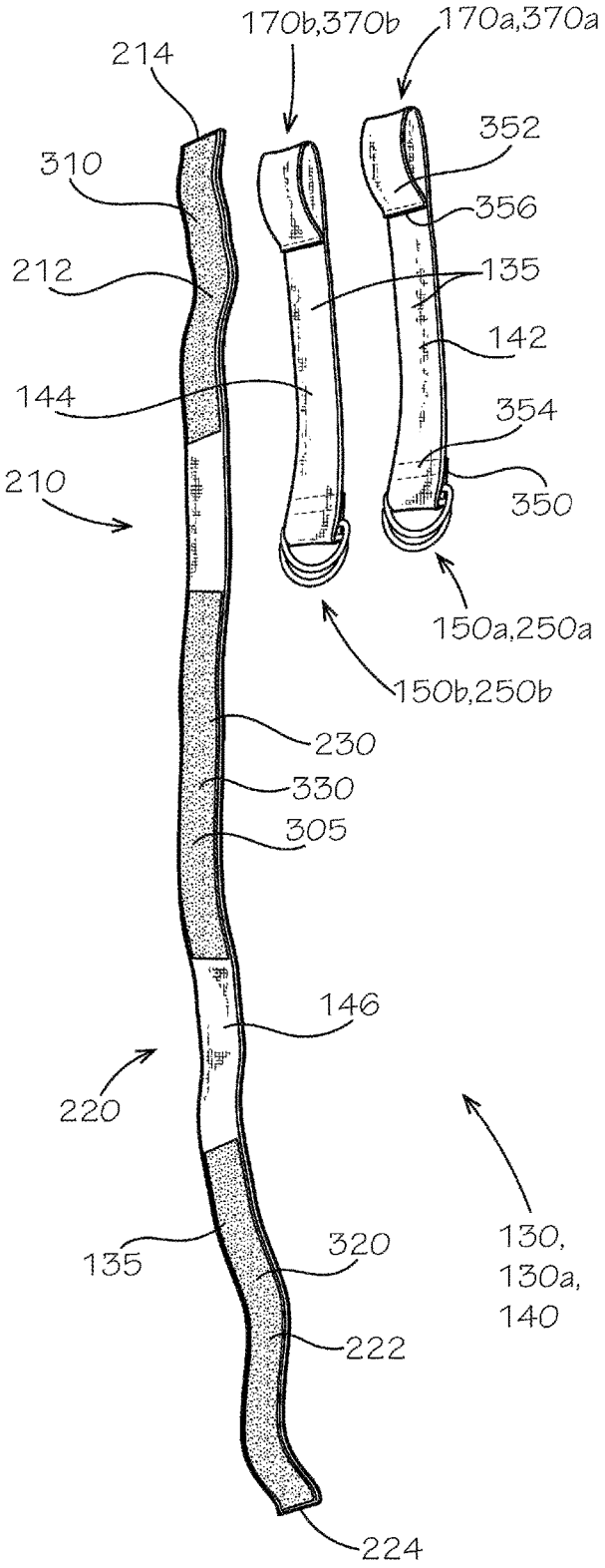
FIG. 3 is a front view of the first stretching attachment of FIG. 1 in a disassembled configuration.

FIG. 2 illustrates the body stretching harness 140 detached from the support bar 110 (shown in FIG. 1), and FIG. 3 illustrates each of the straps 135 of the body stretching harness 140 detached from one another. Referring to FIG. 2, as shown, the body stretching harness 140 comprises a plurality of the straps 135, including the first end strap 142, the second end strap 144, and the middle strap 146 extending therebetween. The middle strap 146 can define a first strap section 210 and an opposite second strap section 220. The first strap section 210 of the middle strap 146 can be coupled to the first end strap 142 by a first one of the strap connectors 150*a*, and the second strap section 220 of the middle strap 146 can be coupled to the second end strap 144 by a second one of the strap connectors 150*b*. In the present aspect, the first and second strap connectors 150*a,b* can be first and second double D-ring connectors 250*a,b*, respectively; however, in other aspects, the middle strap 146 can be connected to the first and second end straps 142,144 by any other suitable connection mechanism known in the art.

According to example aspects, a first extension portion 212 of the first strap section 210 of the middle strap 146 can be threaded through the corresponding first double D-ring connector 250*a* and can define a first free end 214 distal to the first double D-ring connector 250*a*. Similarly, a second extension portion 222 of the second strap section 220 can be threaded through the corresponding second double D-ring connector 250*b* and can define a second free end 224 distal to the second double D-ring connector 250*b*. An intermediate portion 230 of the middle strap 146 can be defined between the first and second extension portions 212,222 (e.g., between the first and second double D-ring connectors 250*a,b*). In example aspects, a position of each of the first and second double D-ring connectors 250*a,b* along the middle strap 146 can be adjusted by threading each of the first and second extension portions 212,222 further into or out of the corresponding first and second double D-ring connectors 250*a,b*. Adjusting the position of the first and/or second double D-ring connectors 250*a,b* can adjust a length of each of the first and second extension portions 212,222, respectively, and can thus adjust a length of the intermediate portion 230 extending between the first and second extension portions 212,222. As such, an overall length L of the body stretching harness 140 can be adjusted by adjusting the position of the first and/or second double D-ring connectors 250*a,b* along the middle strap 146. Adjusting the overall length L of the body stretching harness 140 can allow the body stretching harness 140 to accommodate users of varying body dimensions, such as varying height or arm length, and/or can accommodate for various different types of stretches for which the stretching apparatus 100 can be used. In some example aspects, at least a portion of one or both of the first and second extension portions 212,222 can be folded over and releaseably secured to the intermediate portion 230 of middle strap 146, as described in further detail below.

Referring to FIG. 3, each of the first and second end straps 142,144 are shown detached from the middle strap 146. As shown, the middle strap 146 can define the first strap section 210 and the opposing second strap section 220. The middle strap 146 can further define the first extension portion 212, the opposing second extension portion 222, and the intermediate portion 230 therebetween. Each of the first and second extension portions 212,222 can define the first and second free ends 214,224, respectively, each of which can be distal to the intermediate portion 230. In some aspects, the intermediate portion 230 can comprise an intermediate strap fastener 330, the first extension portion 212 can comprise a first strap fastener 310, and the second extension portion 222 can comprise a second strap fastener 320. For example, in the present aspect, each of the first, second, and intermediate strap fasteners 310,320,330 can be a hook and loop fastener 305 (e.g., a Velcro fastener). In other aspects, the first, second, and intermediate strap fasteners 310,320,330 can be any other suitable fastener known in the art, such as, for example, snap fasteners, and still other aspects may not comprise the first, second, and intermediate strap fasteners 310,320,330. According to example aspects, the first strap fastener 310 can be releasably secured to the intermediate strap fastener 330, and the second strap fastener 320 can be releasably secured to the intermediate strap fastener 330 to releasably couple each of the first and second extension portions 212,222 to the intermediate portion 230, as is illustrated in FIG. 2. Coupling each of the first and second extension portions 212,222 to the intermediate portion 230 can aid in preventing the first and second extension portions 212,222 from inadvertently threading back through the corresponding first and second strap connectors 150*a,b*. It can further aid in preventing a large length of each of the first and second extension portions 212,222 from hanging away from the stretching apparatus 100 (shown in FIG. 1) during use and potentially interfering with the operation of the stretching apparatus 100.

In example aspects, each of the first and second end straps 142,144 can be substantially the same. Referring to the first end strap 142, which can also be representative of the second end strap 144, the first end strap 142 can define a proximal end 350 and an opposing distal end 352. The first strap connector 150*a* (e.g., the first double D-ring connector 250*a*) can be coupled to the first end strap 142 at the proximal end 350 thereof. In the present aspect, the first strap connector 150*a* can be secured to the first end strap 142 by looping the corresponding proximal end 350 of the first end strap 142 through the first strap connector 150*a* and securing the proximal end 350 to the first end strap 142 at a first inward location 354 along a length of the first end strap 142. This can define a strap loops 560 (shown in FIG. 5) at the proximal end 350, within which a portion of the first strap connector 150*a* can be retained to couple the first strap connector 150*a* to the first end strap 142. In some aspects, the proximal end 350 can be secured to the first end strap 142 at the first inward location 354 by sewing. In other aspects, the proximal end 350 can be secured by any other suitable fastener known in the art, including but not limited to, mechanical fasteners, such as snaps, and adhesives, such as glue.

According to example aspects, the first bar connector 170*a* can be defined at the distal end 352 of the first end strap 142, and the second bar connector 170*b* can be defined at the distal end 352 of the second end strap 144. As such, each of the first and second bar connectors 170*a,b* can be disposed substantially opposite the corresponding first and second strap connectors 150*a,b*, respectively. In the present aspect, the first and second bar connectors 170*a,b* can be first and second looped connectors 370*a,b*; however, in other aspects, first and second bar connectors 170*a,b* can be any other suitable connection mechanism known in the art that can couple the body stretching harness 140 to the support bar 110 (shown in FIG. 1). Referring again to the first end strap 142 as an example, which can also be representative of the second end strap 144, the first looped connector 370*a* can be formed by folding the corresponding distal end 352 over the first end strap 142 and securing the distal end 352 to the first end strap 142 at a second inward location 356 along the length thereof. In the present aspect, the distal end 352 can be secured to the first end strap 142 at the second inward location 356 by sewing. However, in other aspects, the distal end 352 can be secured at the second inward location 356 by any other suitable fastener known in the art including but not limited to, mechanical fasteners, such as snaps, and adhesives, such as glue.

Figure 4:
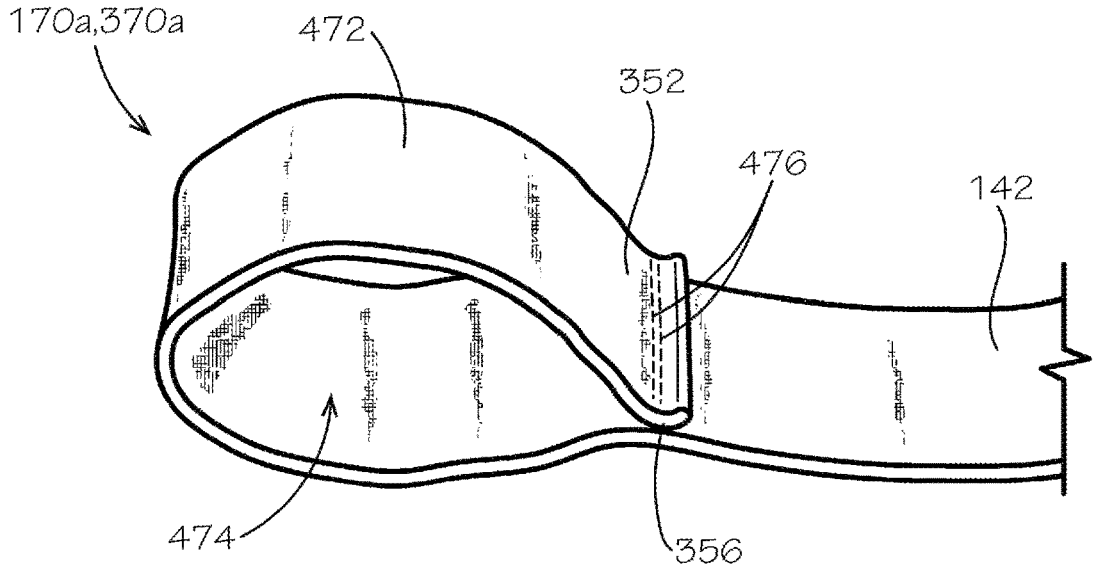
FIG. 4 is a detail view of a bar connector of the first stretching attachment of FIG. 1.

FIG. 4 illustrates a close-up view of the first bar connector 170*a* of the first end strap 142, which, in the present aspect, can be the first looped connector 370*a*. The first looped connector 370*a* can be substantially representative of the second looped connector 370*b* (shown in FIG. 3) of the second end strap 144. As shown, the first looped connector 370*a* can define a loop opening 474 through which the support bar 110 (shown in FIG. 1) can extend. In example aspects, each of the first and second looped connectors 370*a,b* can be configured slide along the support bar 110 to selectively reposition the first and second looped connectors 370*a,b* along the length of the support bar 110. Repositioning the first and second looped connectors 370*a,b* along the support bar 110 can allow the body stretching harness 140 to accommodate users of varying body dimensions, such as varying height or arm length, and/or can accommodate for various different types of stretches for which the stretching apparatus 100 can be used. In some aspects, the first and second looped connectors 370*a,b* can also be configured to be selectively slid off the bar first end 112 and/or bar second end 114 of the support bar 110, such that the body stretching harness 140 can be used independent of the support bar 110, or vice versa, and/or for interchanging the body stretching harness 140 with another one of the stretching attachments 130.

According to example aspects, the first looped connector 370*a* can be formed by folding the distal end 352 of the first end strap 142 over the first end strap 142 to form a loop 472 defining the loop opening 474, as shown. The distal end 352 can then be secured to the first end strap 142 at the second inward location 356 along the length of the first end strap 142. In the present aspect, a seam 476 can be provided by sewing to secure the distal end 352 to the first end strap 142 at the second inward location 356. In other aspects, the distal end 352 can be secured to the first end strap 142 by any other suitable fastener known in the art, including, but not limited to, adhesives, such as glue, mechanical fasteners, such as staples, or any other suitable type of fastener known in the art. According to example aspects, the loop opening 474 of the first looped connector 370*a* can be sized such that a friction fit can be defined between the first looped connector 370*a* and the support bar 110 when the support bar 110 extends through the loop opening 474. As such, the first looped connector 370*a* will remain in position along the support bar 110 during normal use, but can be slid along the support bar 110 upon application of a suitable force. The second looped connector 370*b* can be substantially similar to the first looped connector 370*a*.

Figure 5:
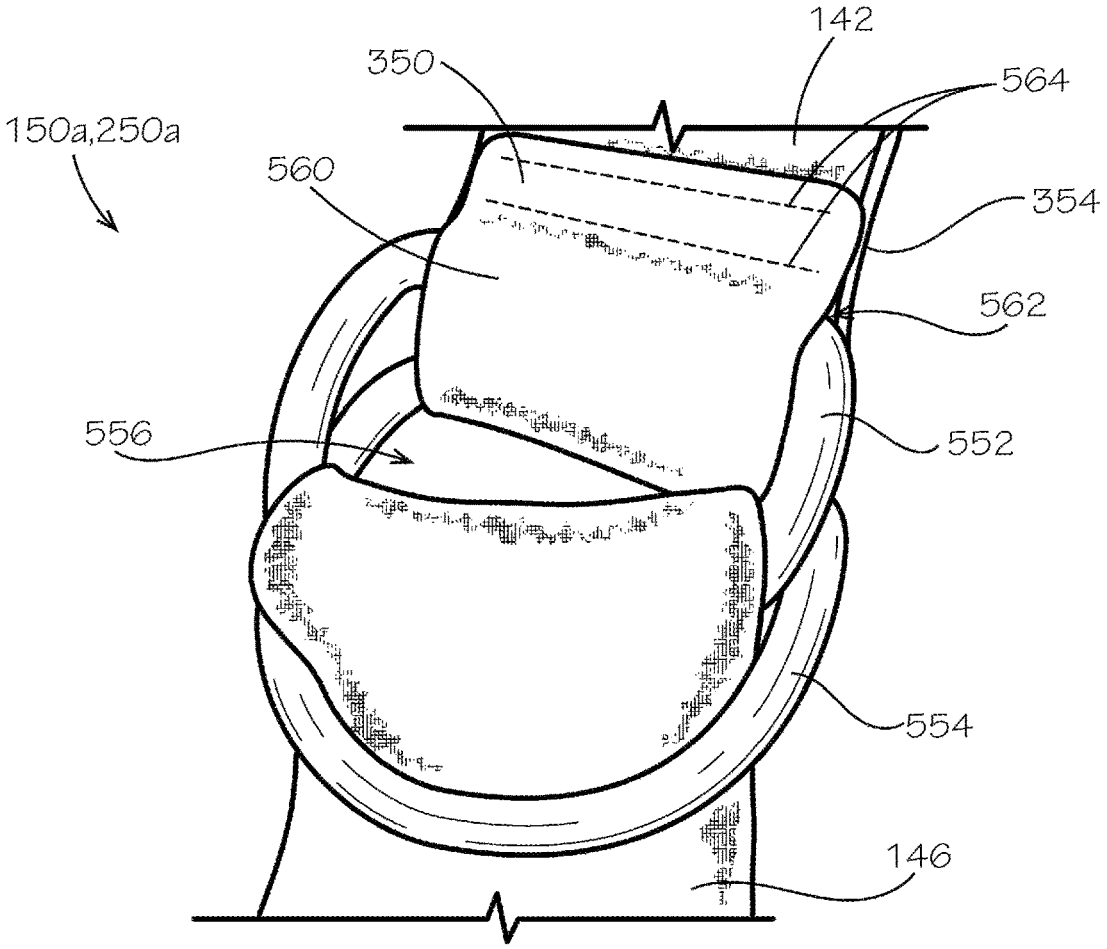
FIG. 5 is a detail view of a strap connector of the first stretching attachment of FIG. 1.

FIG. 5 illustrates a close-up view of the first strap connector 150*a* of the first end strap 142, which, in the present aspect, can be the first double D-ring connector 250*a*. The first double D-ring connector 250*a* can be substantially representative of the second double D-ring connector 250*b* (shown in FIG. 2) of the second end strap 144 (shown in FIG. 1). As shown, the first double D-ring connector 250*a* can comprise a first D-ring 552 and a second D-ring 554, and each of the first and second D-rings 552,554 can define a D-ring opening 556 therethrough. As described above, the proximal end 350 of the first end strap 142 can be fed through the D-ring openings 556 of the first and second D-rings 552,554, and can further be folded over and secured to the first end strap 142 at the first inward location 354 to define the strap loops 560. In the present aspect, a seam 564 can secure the proximal end 350 to the first end strap 142, through in other aspects, any other suitable fastener can be utilized. The strap loops 560 can define a strap opening 562, and a portion of each of the first and second D-rings 552,554 can be received through the strap opening 562, as shown, to secure the first and second D-rings 552,554 to the first end strap 142.

According to example aspects, a position of the first double D-ring connector 250*a* can be adjust along a length of the middle strap 146 to adjust the overall length L (shown in FIG. 2) of the body stretching harness 140 (shown in FIG. 1). As shown, the middle strap 146 can be threaded over the first D-ring 552 and under the second D-ring 554, which can adjustably secure the middle strap 146 to the first end strap 142. To reposition the first double D-ring connector 250*a* along the middle strap 146, the middle strap 146 can be fed further through or out of the first double D-ring connector 250*a*. Feeding the middle strap 146 further through the first double D-ring connector 250*a* can shorten the intermediate portion 230 of the middle strap 146, thereby shortening the overall length L of the body stretching harness 140. Correspondingly, feeding the middle strap 146 further out of the double D-ring connector can lengthen the intermediate portion 230, thereby lengthening the overall length L of the body stretching harness 140. The middle strap 146 can be similarly adjusted through the second double D-ring connector 250*b*.

Figure 6:
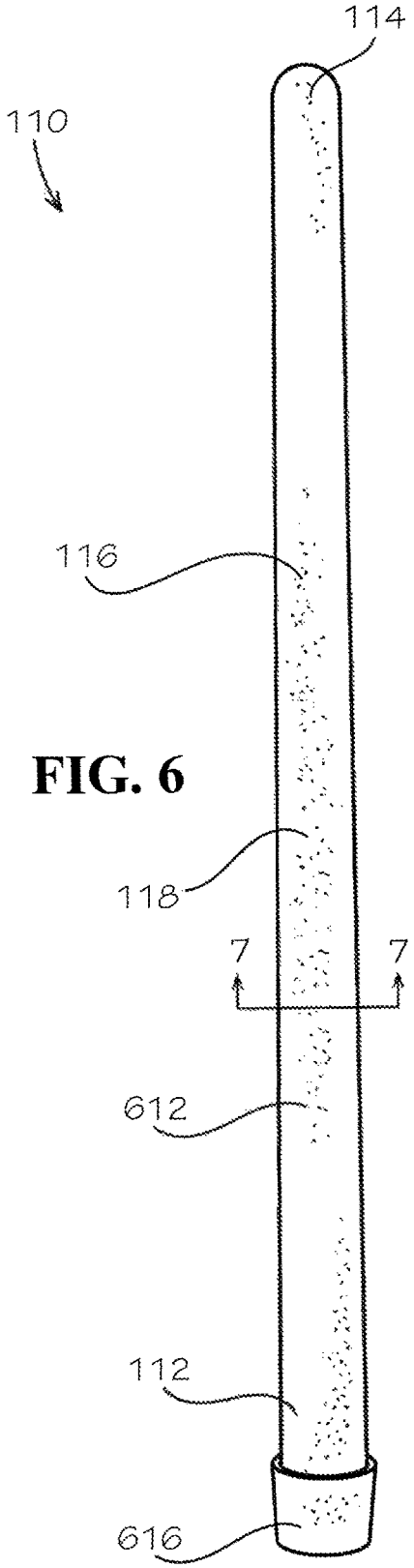
FIG. 6 is a front view of the support bar of FIG. 1.

FIG. 6 illustrates the support bar 110 according to one aspect of the present disclosure, wherein the body stretching harness 140 is removed for full visibility of the support bar 110. In some aspects, the support bar 110 alone can serve as the stretching apparatus 100. According to example aspects, the support bar 110 can define a substantially elongate cylindrical shape and can define the bar first end 112 and the opposite bar second end 114. The bar middle region 116 can extend between the bar first and bar second ends 112,114. In the present aspect, the support bar 110 can comprise an outer casing 612 enveloping a hollow interior 714 (shown in FIG. 7) of the support bar 110. The outer casing 612 can be substantially cylindrical in shape and can comprise any suitable material, including, but not limited to, cloth, plastic, rubber, foam, composites, metal, and the like. In the present aspect, the outer casing 612 can comprise a flexible plastic material. In some example aspects, the outer casing 612 can define a casing first opening (not shown) at the bar first end 112, which can allow access to the interior 714 of the support bar 110. In the present aspect, as shown, the support bar 110 can further comprise a first end cap 616 oriented at the bar first end 112, which can serve to cover the casing first opening. In other aspects, the support bar 110 can also comprise a second end cap oriented at the bar second end 114, which may be configured to cover a casing second opening at the bar second end 114. Various aspects of the support bar 110 may or may not comprise the casing first opening, casing second opening, first end cap 616, and/or second end cap.

Figure 7:
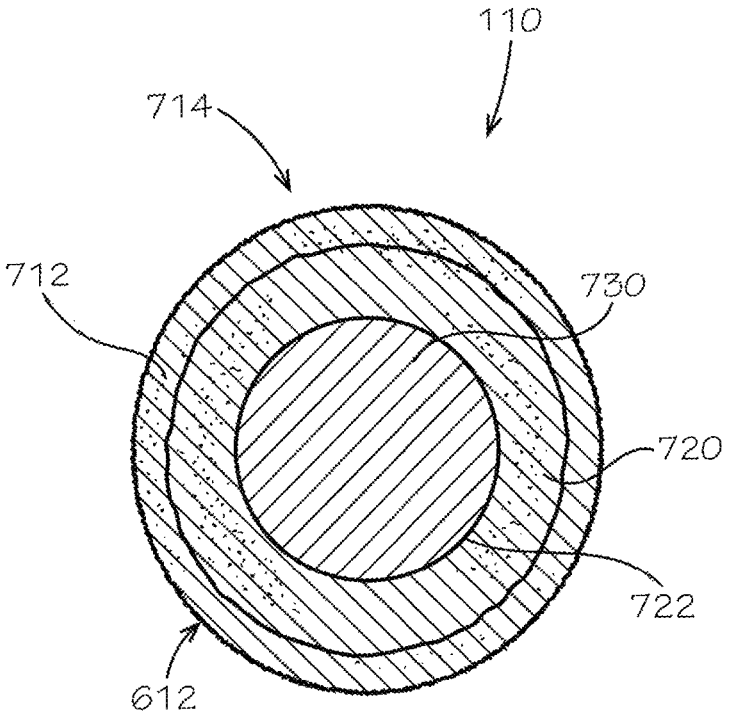

FIG. 7 illustrates a cross-sectional view of the support bar 110 showing the interior 714 thereof, according to an example aspect. As shown, the support bar 110 comprises the outer casing 612, and in some aspects, the outer casing 612 can comprise a cushioning interior lining 712 applied thereto. Example aspects of the interior lining 712 can comprise a resilient material, such as tufted cotton. Other aspects of the outer casing 612 may not comprise the interior lining 712. In the present aspect, the support bar 110 can further comprise a cushioning member, such as a cushioning insert 720, and a reinforcement member, such as a reinforcement insert 730, received within the interior 714 defined by the outer casing 612. According to example aspects, the cushioning insert 720 can be substantially cylindrical in shape and can comprise a resilient material. In the present aspect, the cushioning insert 720 can comprise a foam material, such as polyethylene foam. In other aspects, the cushioning insert 720 can comprise any other suitable resilient material, such as rubber, polystyrene foam, polyurethane foam, or the like. As shown, the cushioning insert 720 can be substantially sized and shaped such that minimal clearance, if any, is defined between the cushioning insert 720 and the outer casing 612. In some aspects, a friction fit can be defined between the cushioning insert 720 and the outer casing 612, such that the cushioning insert 720 can be snugly received within the interior 714 of the support bar 110.

According to example aspects, the cushioning insert 720 can further define a hollow core 722, within which the reinforcement insert 730 can be received. Example aspects of the reinforcement insert 730 can be substantially rigid and can be configured to improve the strength of the support bar 110, which can be beneficial when forces are applied thereto during use of the stretching apparatus 100 (shown in FIG. 1). In the present aspect, the reinforcement insert 730 can comprise a wood material. However, in other aspects, the reinforcement insert 730 can comprise any other suitable material for providing added strength to the support bar 110, including, but not limited to, plastics, composites, metals, rubbers, and the like. Moreover, as shown, in various aspects, each of the hollow core 722 and the reinforcement insert 730 can be substantially cylindrical in shape, defining a substantially circular cross-sectional shape. In the present aspect, the reinforcement insert 730 can be sized and shaped to fit snugly within the hollow core 722 of the cushioning insert 720, and a friction fit can retain the reinforcement insert 730 therein. In some aspects, one or more fasteners may be provided to securing the various components of the support bar 110 together, such as, for example, adhesive, mechanical fasteners, or any other suitable fastener known in the art.

Figure 8:
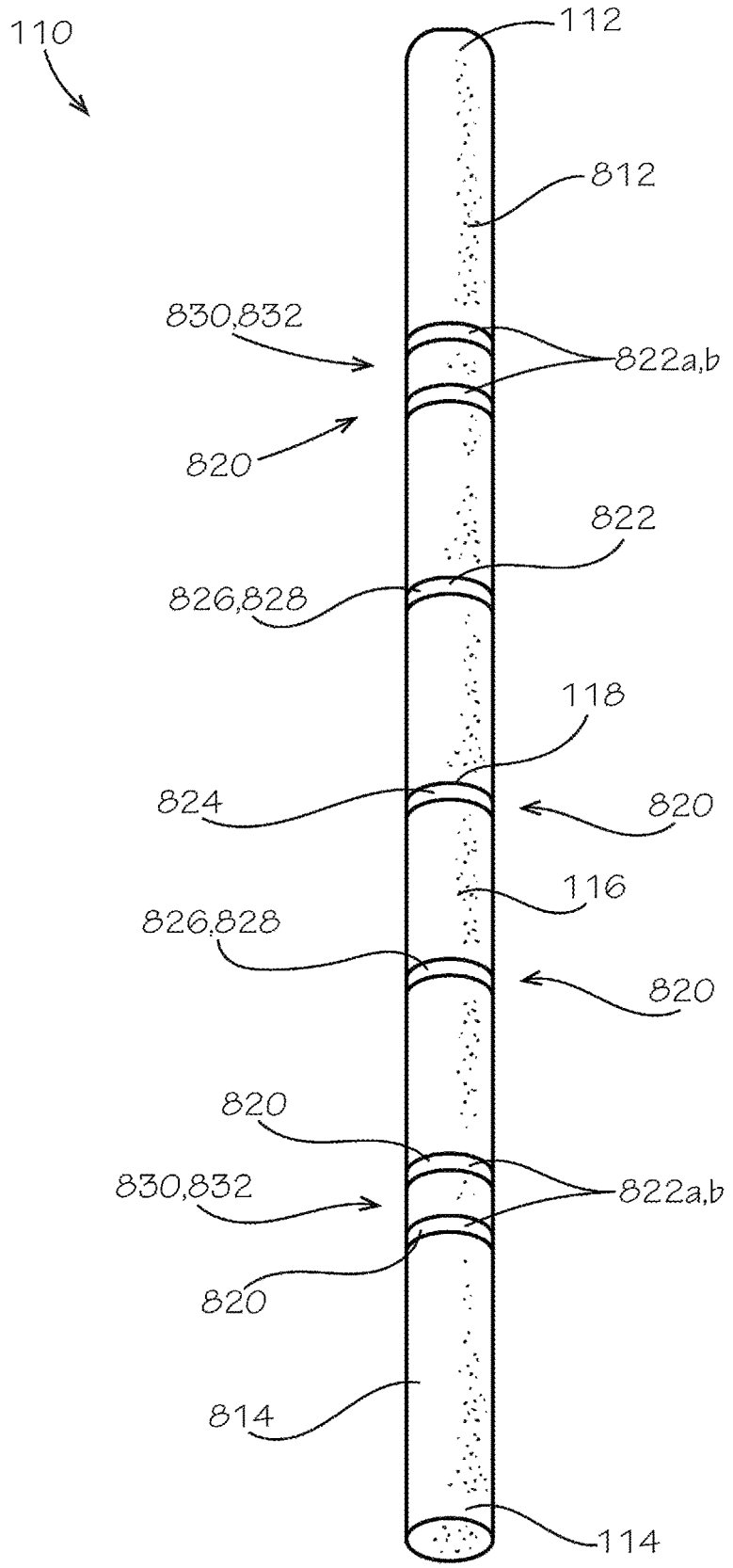
FIG. 8 is a front view of the support bar, in accordance with another aspect of the present disclosure.

FIG. 8 illustrates the support bar 110 according to another example aspect of the disclosure. As shown, the support bar 110 of the present aspect can be substantially similar in size and shape to the support bar 110 of FIGS. 1, 6, and 7. However, the present support bar 110 does not comprise the outer casing 612 (shown in FIG. 6). Rather the support bar 110 comprises the cushioning member, which in the present aspect can be a cylindrical outer padding 812. In example aspects, the cylindrical outer padding 812 can be similar to or the same as the cushioning insert 720 of FIG. 7. Other aspects of the outer padding 812 can be substantially different from the cushioning insert 720. The cylindrical outer padding 812 can be solid in some aspects, and can define the hollow core 722 (shown in FIG. 7) in other aspects. In aspects comprising the hollow core 722, the reinforcement member, such as the reinforcement insert 730 of FIG. 7, may be received therein to provide added strength to the support bar 110. Furthermore, in the present aspect, the support bar 110 can comprise one or more visual indicators 820. The visual indicator(s) 820 can be located on an outer surface 814 of the support bar 110, such that the visual indicator(s) 820 can be visible to a user. In the present aspect, the visual indicators 820 can be formed separately from the outer padding 812 and can be attached to the outer surface 814 thereof. In other aspects, the visual indicators 820 can be monolithically formed with the outer surface 814 of the support bar 110 (i.e., the outer padding 812 and visual indicators 820 can be formed as a singular component).

In the present aspect, the visual indicators 820 can comprise bands 822 wrapped around the outer surface 814. For example, in some aspects, each of the center indicator 824 and the intermediate indicators 826 can comprise a single one of the bands 822, while each of the outer indicators 830 can comprise a pair of the bands 822*a,b*. The bands 822 can be coupled to themselves or to the outer surface 814 to retain the bands 822 on the support bar 110. For example, the bands 822 may be coupled to themselves or the outer surface 814 by an adhesive, such as glue or tape, a mechanical fastener, or any other suitable fastener known in the art. In other aspects, the visual indicators 820 can comprise tape, stickers, or can be dyed, printed, or painted onto the outer surface 814 of the support bar 110, or can comprise any other suitable indicator or can be formed by any other suitable method known in the art. Moreover, in the present aspect, the visual indicators 820 can comprise varying colors indicative of the varying purposes of the visual indicators 820. In other aspects, the visual indicators 820 may comprise varying shapes or sizes, varying graphics or words shown thereon, or any other suitable variations to indicate the purpose of the visual indicators 820. In still other aspects, all of the visual indicators 820 may be substantially uniform in appearance.

A plurality of the visual indicators 820 are provided in the present aspect. The visual indicators 820 can include, for example and without limitation, a center indicator 824, a pair of intermediate indicators 826, and a pair of outer indicators 830. Other aspects can comprise more or fewer of the visual indicators 820, which may indicate the same or varying purposes. The center indicator 824 can indicate the midpoint 118 of the support bar 110. In various stretches, it may be desired for a user to engage the midpoint 118 of the support bar 110 or for one of the stretching attachments 130 to be coupled to the support bar 110 at the midpoint 118. As such, in some aspects, the purpose of the center indicator 824 can be to indicate a preferred engagement point for the user or a preferred attachment point for a one (or multiple) of the stretching attachments 130 (shown in FIG. 1). For example, in a particular aspect, the center indicator 824 can indicate a preferred attachment point for a neck stretching harness 940 (shown in FIG. 9) and/or a center stretching strap 1140 (shown in FIG. 11).

In the present aspect, the pair of intermediate indicators 826 can serve as a pair of foot indicators 828. The foot indicators 828 can be oriented on either side of and equally spaced from the center indicator 824. In various stretches, it may be desired to engage the support bar 110 with the user's feet 1120 (shown in FIG. 11). For example, in a particular stretch, the support bar 110 can be placed on a ground surface (e.g., the floor) and a user can place each of their feet 1120 on a corresponding one of the foot indicators 828. The user can then pull generally upward on the center stretching strap 1140, which can be attached to the support bar 110 at the center indicator 824. This stretch can be configured to stretch various back muscles. In other aspects, the intermediate indicators 826 may instead or also indicate desired hand placement (or placement of another body part) for certain stretches, can indicate a preferred attachment point for one or more of the stretching attachments 130, or can have any other suitable purpose.

The pair of outer indicators 830 can be hand indicators 832 in the present aspect. The hand indicators 832 can be oriented on either side of and equally spaced from the foot indicators, distal from the center indicator 824, as shown. In various stretches, it may be desired to grip the support bar 110 with the user's hands 1110 (shown in FIG. 11). For example, in a particular stretch, the body stretching harness 140 (shown in FIG. 1) can be configured to wrap around a user's back and under the user's arms. The user can grip each of the hand indicators 832 with a corresponding one of their hands 1110, and can bias the support bar 110 away from their body—for example, the user can push the support bar 110 with their hands 1110 in a generally forward and/or generally upward direction away from their body. This stretch can be configured to stretch various back, shoulder, and/or arm muscles. In other aspects, the outer indicators 830 may instead or also indicate desired foot placement (or desired placement of another body part) for certain stretches, can indicate a preferred attachment point for one or more of the stretching attachments 130, or can have any other suitable purpose. For example, in a particular aspect, the outer indicators 830 may indicate preferred attachment points for the first and second bar connectors 170*a,b* (shown in FIG. 1) of the body stretching harness 140.

Figure 9:
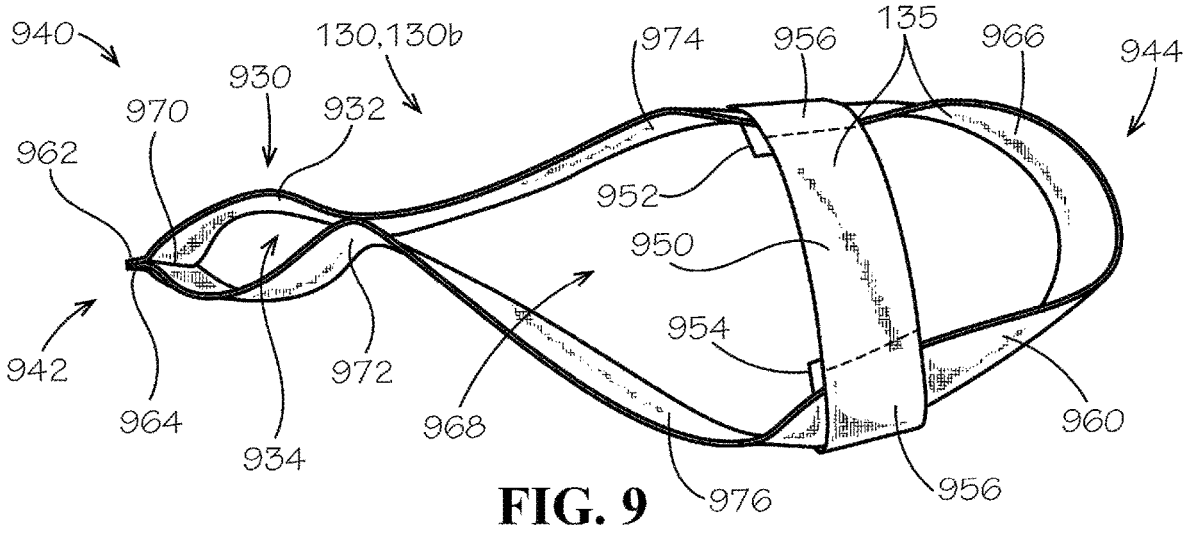
FIG. 9 is a rear view of a second stretching attachment, according to another aspect of the present disclosure.
Figure 10:
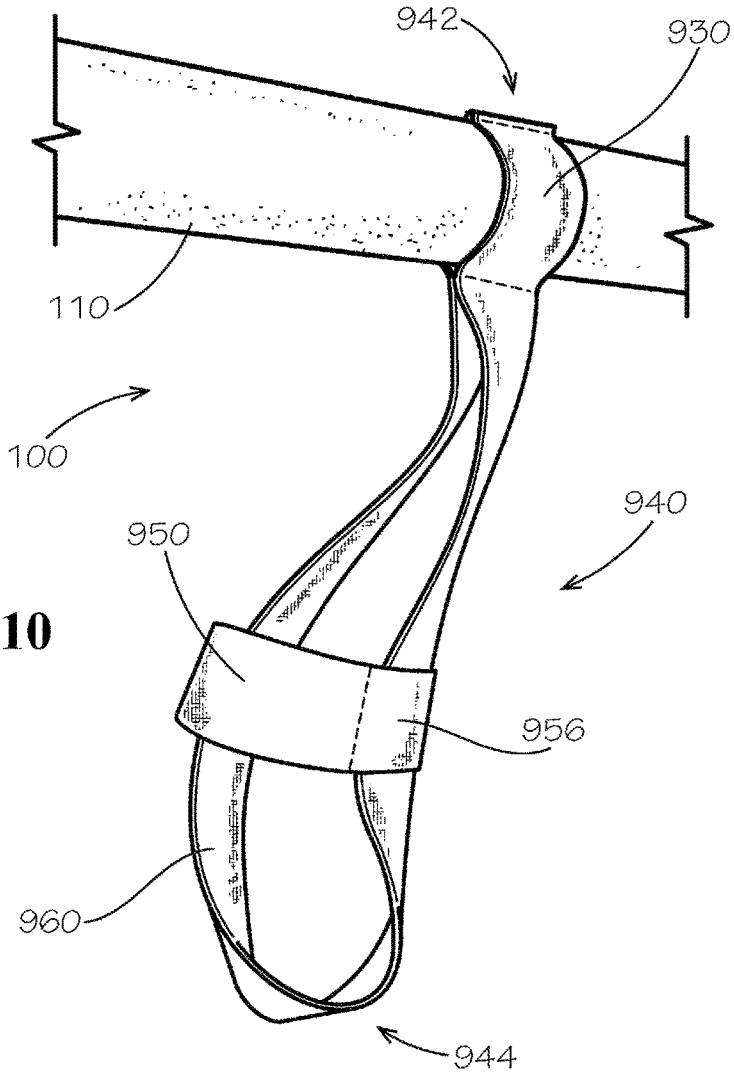
FIG. 10 is a perspective view of the stretching apparatus in accordance with another aspect of the present disclosure, wherein the stretching apparatus comprises the support bar of FIG. 1 and the second stretching attachment of FIG. 9.

FIGS. 9 and 10 illustrate an example aspect of a second one of the stretching attachments 130*b*, wherein the second stretching attachment 130*b* can be the neck stretching harness 940. According to example aspects, the neck stretching harness 940 can comprise a plurality of the straps 135. For example, the straps 135 can comprise a head strap 950 and a chin strap 960. Example aspects of the head strap 950 and chin strap 960 can comprise a flexible, but substantially inelastic material, such as, for example, nylon webbing, as described above. The neck stretching harness 940 can further comprise a bar attachment 930, which can be substantially similar to the bar connectors 170 (shown in FIG. 1) of the body stretching harness 140 (shown in FIG. 1). For example, the bar attachment 930 can be a looped bar attachment 932 defining a looped attachment opening 934 through which the support bar 110 (shown in FIG. 10) can extend to attach the neck stretching harness 940 to the support bar 110.

As shown, in the present aspect, the neck stretching harness 940 can generally define a first lateral end 942 and a second lateral end 944 distal to the first lateral end 942, relative to the orientation shown in FIG. 9. The chin strap 960 can define a chin strap loop 966, which can be configured to loop underneath and cradle the chin of a user at the first lateral end 942 of the neck stretching harness 940. The chin strap loop 966 can define a chin strap opening 968, and the user's head can engage the chin strap opening 968. In some aspects, the chin strap 960 can also define the bar attachment 930, as shown. For example, in the present aspect, the bar attachment 930 can be defined at the second lateral end 944 of the neck stretching harness 940, opposite the first lateral end 942. According to example aspects, a first chin strap end 962 of the chin strap 960 can be secured to a second chin strap end 964 of the chin strap 960 at a first location 970. For example, the first chin strap end 962 can be secured to the second chin strap end 964 by sewing in some aspects. Furthermore, the first location 970 can be oriented at or near the second lateral end 944 of the neck stretching harness 940. As shown, the chin strap 960 can also be secured to itself at a second location 972 spaced from the first location 970, to define the looped bar attachment 932 and looped attachment opening 934 between the first and second locations 970,972. The chin strap 960 can be secured to itself at the second location 972 by sewing in example aspects. In other aspects, the chin strap 960 can be secured to itself at the first and second locations 970,972 by any other suitable fastener known in the art, including adhesives or mechanical fasteners.

The head strap 950 of the neck stretching harness 940 can be coupled to the chin strap 960, and can be selectively repositionable generally along a length of the chin strap 960 in some aspects. Example aspects of the head strap 950 can define a first head strap end 952 and a second head strap end 954 distal to the first head strap end 952, and each of the first and second head strap ends 952,954 can be connected to corresponding first and second sides 974,976 of the chin strap 960, respectively, as shown. In the present aspect, a head strap loop 956 can be formed at each of the first and second head strap ends 952,954, and the chin strap 960 can be configured to extend through each of the head strap loops 956. In some aspects, the chin strap 960 can slide within the head strap loops 956 to adjust the position of the head strap 950 relative to the chin strap 960. The head strap loops 956 can also be formed similarly to bar connectors 170 of the body stretching harness 140. For example, each of the first and second head strap ends 952,954 can be configured to fold over the head strap 950 and can be secured thereto, such as by sewing, to define the corresponding head strap loops 956. In other aspects, the head strap loops 956 may not be adjustable along the length of the chin strap 960. Furthermore, in other aspects, the head strap 950 may not define the head strap loops 956 and can be secured to the chin strap 960 by any other suitable fastening mechanism(s) known in the art. According to example aspects, the head strap 950 can be configured to wrap behind and cradle a lower back portion of the user's head.

FIG. 10 illustrates an example aspect of the stretching apparatus 100 comprising the neck stretching harness 940. To use the neck stretching harness 940, the neck stretching harness 940 can be attached to the support bar 110 and the user can hold the support bar 110 generally above their head. The chin strap 960 of the neck stretching harness 940 can cradle the user's chin and the head strap 950 of the neck stretching harness 940 can cradle the lower back portion of the user's head. The user can stretch their neck with the stretching apparatus 100 by pushing the support bar 110 generally upward, relative to the orientation shown, to draw the head generally upward along with the support bar 110 and away from the body, thus elongating and stretching various muscles in the neck.

Figure 11:
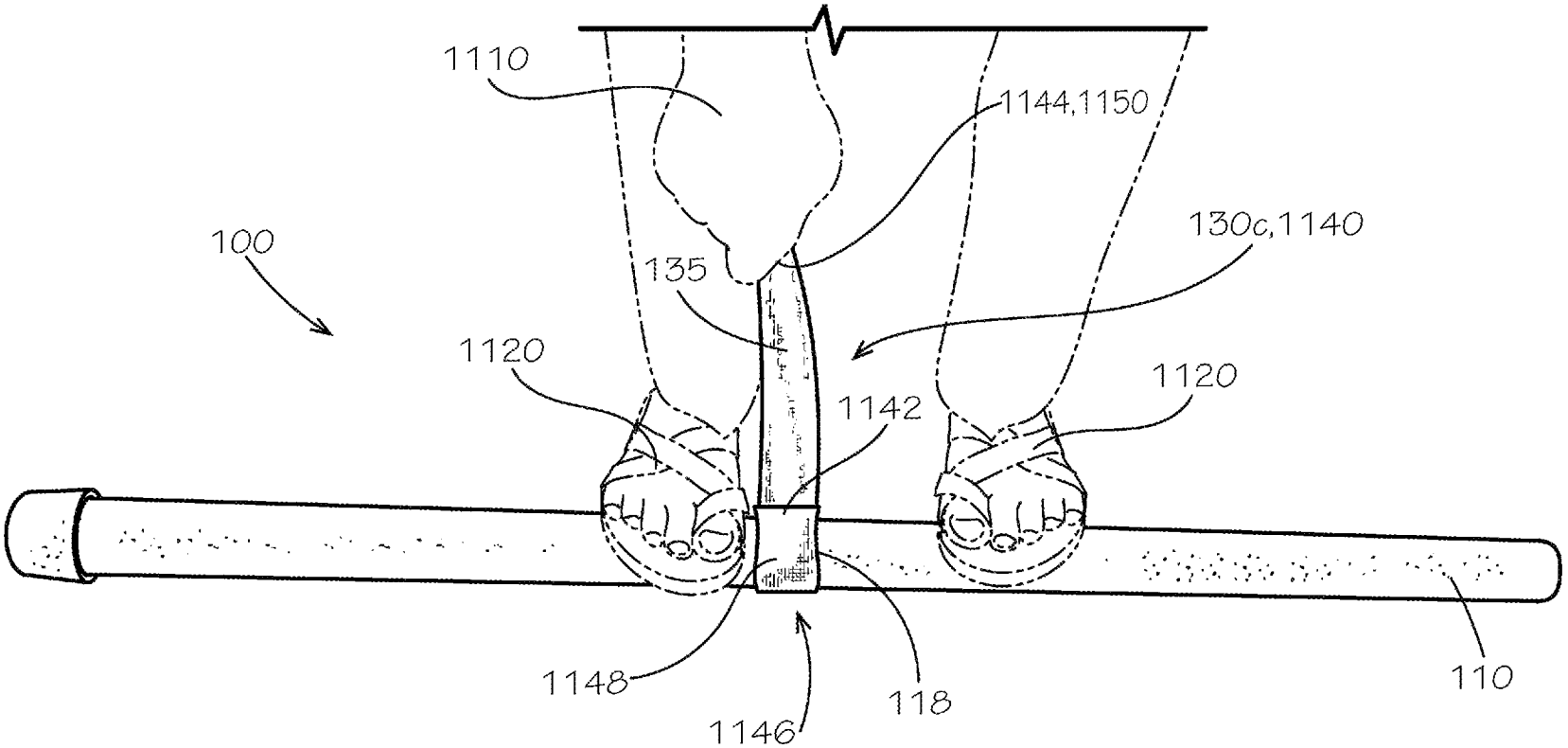
FIG. 11 illustrates the stretching apparatus in accordance with another aspect of the present disclosure, wherein the stretching apparatus comprises the support bar of FIG. 1 and a third stretching attachment.

FIG. 11 illustrates an example aspect of the stretching apparatus 100 comprising a third one of the stretching attachments 130*c*, wherein the third stretching attachment 130*c* can comprise a single one of the straps 135. In the present aspect, the singular strap 135 can be the center stretching strap 1140. Example aspects of the center stretching strap 1140 can comprise a flexible, but substantially inelastic material, such as, for example, nylon webbing, as described above. As described above with reference to FIG. 8, the center stretching strap 1140 can be attached to the support bar 110 generally at or near the midpoint 118 thereof. As shown, the center stretching strap 1140 can define a first center strap end 1142 and a second center strap end 1144 distal to the first center strap end 1142, and the first center strap end 1142 can be coupled to the support bar 110. In example aspects, the first center strap end 1142 can define a center strap attachment 1146 for attaching the center stretching strap 1140 to the support bar 110. In some aspects, the center strap attachment 1146 can be substantially similar to the bar connectors 170 (shown in FIG. 1) of the body stretching harness 140 (shown in FIG. 1), wherein the first center strap end 1142 can fold over the center stretching strap 1140 and can be secured thereto to define a center strap attachment loop 1148. In some aspects, the first center strap end 1142 can be secured to the center stretching strap 1140 by sewing, though in other aspects, any other suitable fastener known in the art can be utilized, including adhesives and mechanical fasteners. According to example aspects, the support bar 110 can extend through the center strap attachment loop 1148 to couple the center stretching strap 1140 to the support bar 110.

Furthermore, example aspects of the second center strap end 1144 can define a hand grip portion 1150 at the second center strap end 1144, which can be gripped by one or both of the user's hands 1110. In a particular aspect, to use the center stretching strap 1140, the support bar 110 can be placed on a ground surface and the user can place their feet 1120 on the support bar 110 on either side of the center stretching strap 1140, as shown. In some aspects, the foot indicators 828 (shown in FIG. 8) may be present to indicate ideal placement of the user's feet 1120 on the support bar 110. The user can then grip the hand grip portion 1150 at the second center strap end 1144 with one or more hands 1110 and pull in a generally upward direction on the center stretching strap 1140, which can aid in stretching various muscles in the user's back.

As such, according to example aspects, a method for using the stretching apparatus 100 to stretch a user's body can comprise providing the stretching apparatus 100, the stretching apparatus 100 comprising the support bar 110 and at least one of the stretching attachments 130 coupled to the support bar 110, the stretching attachment 130 comprising at least one of the straps 135, the strap 135 comprising a flexible, inelastic material, engaging the stretching attachment 130 with the user's body, and biasing the support bar 110 away from the user's body. In some aspects, the stretching attachment 130 can be the body stretching harness 140, which can comprise the first strap connector 150*a* and the second strap connector 150*b*, wherein the support bar 110 can engage each of the first strap connector 150*a* and second strap connector 150*b*. In such an aspects, engaging the stretching attachment 130 with the user body comprises wrapping the body stretching harness 140 around the user's back and under the user's arms, and biasing the support bar 110 away from the user's body comprises gripping the support bar 110 with the user's hands 1110 and pushing the support bar 110 in a generally upward direction away from the user's body. In other aspects, the strap 135 can be the chin strap 960, and the stretching attachment 130 can be the neck stretching harness 940, which can further comprise the head strap 950 and the bar attachment 930, wherein the support bar 110 can engage the bar attachment 930 at the bar midpoint 118 of the support bar 110. In such an aspect, engaging the stretching attachment 130 with the user body can comprise cradling the user's chin with the chin strap 960 and cradling a lower back portion of the user's head with the head strap 950, and biasing the support bar 110 away from the user's body can comprise gripping the support bar 110 with the user's hands 1110 and pushing the support bar 110 in a generally upward direction away from the user's body. Furthermore, in some aspects, the stretching attachment 130 can be a first stretching attachment (e.g., one of the neck stretching harness 940, body stretching harness 140, and center stretching strap 1140), the stretching apparatus 100 further comprising a second stretching attachment (e.g., another one of the neck stretching harness 940, body stretching harness 140, and center stretching strap 1140), and the method further comprises interchanging the first stretching attachment with the second stretching attachment.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A stretching apparatus comprising:

an elongate support bar defining a bar first end and a bar second end opposite the bar first end, the elongate support bar manually repositionable relative to a user's body during use of the stretching apparatus between a first position and a second position;

a body stretching attachment coupled to the elongate support bar, the body stretching attachment comprising a strap assembly, the strap assembly comprising a strap, a first bar connector, and a second bar connector, wherein the strap comprises a first end strap, a second end strap, and a middle strap extending between the first end strap and the second end strap, each of the first end strap, the second end strap, and the middle strap comprising a flexible, inelastic material, the middle strap defining a first extension portion and an intermediate portion; and a first strap connector coupled to the first end strap, the first extension portion of the middle strap extending through the first strap connector to couple the middle strap to the first end strap;

wherein the flexible, inelastic material of the first end strap, the second end strap, and the middle strap prohibits the body stretching attachment from stretching during use of the stretching apparatus, and wherein the stretching apparatus is operable for stretching the user's body using only the elongate support bar, the strap assembly, and the user; and wherein the first bar connector comprises a first free end of the first end strap folded over and secured to the first end strap to define a first strap loop and the second bar connector comprises a second free end of the second end strap folded over and secured to the second end strap to define a second strap loop, the elongate support bar received through each of the first strap loop and the second strap loop;

wherein the middle strap is selectively adjustable relative to the first end strap to adjust an overall length of the body stretching attachment, the overall length is defined as a distance between the first strap loop and the second strap loop, the first extension portion defines a first hook and loop fastener and the intermediate portion defines a second hook and loop fastener, and the first extension portion is folded over the intermediate portion to releasably couple the first hook and loop fastener to the second hook and loop fastener.

2. The stretching apparatus of claim 1, wherein the first strap connector is a double D-ring connector.

3. The stretching apparatus of claim 2, wherein the middle strap is further selectively adjustable relative to the second end strap to further adjust the overall length of the body stretching attachment.

4. The stretching apparatus of claim 3, wherein the body stretching attachment further comprises a second strap connector coupled to the second end strap, a second extension portion of the middle strap opposite the first extension portion extends through the second strap connector to couple the second end strap to the middle strap, and the second strap connector is a double D-ring connector.

5. The stretching apparatus of claim 1, wherein the elongate support bar comprises an outer casing and a cushioning insert, the cushioning insert received in a hollow interior of the outer casing.

6. The stretching apparatus of claim 5, further comprising a reinforcement insert, the reinforcement insert received in a hollow core of the cushioning insert.

7. The stretching apparatus of claim 1, wherein the elongate support bar is slidably received through each of the first strap loop and the second strap loop.

8. The stretching apparatus of claim 7, wherein each of the first bar connector and the second bar connector are formed monolithically with the first end strap and the second end strap.

9. The stretching apparatus of claim 1, wherein the elongate support bar defines at least one visual indicator on an outer surface of the elongate support bar, the at least one visual indicator configured to indicate a preferred attachment point of the body stretching attachment.

10. The stretching apparatus of claim 1, wherein the body stretching attachment is a first stretching attachment, the stretching apparatus further comprising a second stretching attachment interchangeable with the first stretching attachment.

11. The stretching apparatus of claim 1, wherein the elongate support bar defines at least one visual indicator on an outer surface of the elongate support bar, the at least one visual indicator configured to indicate a preferred manual engagement point for a hand of the user to grip during use of the stretching apparatus.

12. The stretching apparatus of claim 1, wherein the strap defines a body engagement portion configured to engage the user's body during use of the stretching apparatus, and wherein the middle strap defines the body engagement portion.

13. A stretching apparatus comprising:

an elongate support bar defining a bar first end and a bar second end opposite the bar first end, the elongate support bar manually repositionable relative to a user's body during use of the stretching apparatus between a first position and a second position; and a body stretching attachment coupled to the elongate support bar, the body stretching attachment comprising a strap assembly, the strap assembly comprising a strap, a first bar connector, and a second bar connector, wherein the strap comprises a flexible, inelastic material, and wherein the elongate support bar engages each of the first bar connector and second bar connector;

wherein the flexible, inelastic material of the strap prohibits the body stretching attachment from stretching during use of the stretching apparatus, and wherein the stretching apparatus is operable for stretching the user's body using only the elongate support bar, the strap assembly, and the user; and wherein:

the strap comprises a primary strap and a secondary strap;

the primary strap comprises a strap connector and is adjustably coupled to the secondary strap by the strap connector to adjust a length of the strap;

the length is defined as a distance between the first bar connector and the second bar connector;

the secondary strap defines a first extension portion extending through the strap connector and an intermediate portion;

the first extension portion defines a first hook and loop fastener and the intermediate portion defines a second hook and loop fastener;

the first extension portion is folded over the intermediate portion to releasably couple the first hook and loop fastener to the second hook and loop fastener.

14. The stretching apparatus of claim 13, wherein the strap connector is a double D-ring connector.

15. The stretching apparatus of claim 14, wherein the primary strap is a first end strap and the secondary strap is a middle strap, the strap further comprises a second end strap, the middle strap extends between the first end strap and the second end strap, and the middle strap is further selectively adjustable relative to the second end strap to further adjust the length of the body stretching attachment.

* * * * *